US009162460B2

(12) United States Patent
Terada

(10) Patent No.: US 9,162,460 B2
(45) **Date of Patent: *Oct. 20, 2015**

(54) INKJET PRINTER AND METHOD FOR DETERMINING INK DISCHARGING TIMING

(71) Applicant: BROTHER KOGYO KABUSHIKI KAISHA, Nagoya, Aichi (JP)

(72) Inventor: Kohei Terada, Kiyosu (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/536,178

(22) Filed: Nov. 7, 2014

(65) Prior Publication Data

US 2015/0062246 A1 Mar. 5, 2015

Related U.S. Application Data

(63) Continuation of application No. 14/228,445, filed on Mar. 28, 2014, now Pat. No. 8,926,037, which is a continuation of application No. 13/729,903, filed on Dec. 28, 2012, now Pat. No. 8,714,681.

(30) Foreign Application Priority Data

Mar. 30, 2012 (JP) ..... 2012-082622

(51) Int. Cl.
*B41J 2/045* (2006.01)
*B41J 2/145* (2006.01)
(Continued)

(52) U.S. Cl.
CPC .. *B41J 2/145* (2013.01); *B41J 2/07* (2013.01); *B41J 11/001* (2013.01); *B41J 11/005* (2013.01); *B41J 25/308* (2013.01)

(58) Field of Classification Search
CPC .... B41J 11/005; B41J 2/04556; B41J 25/308; B41J 2/155; B41J 13/14; B41J 25/3082; B41J 2/04508; B41J 25/00; B41J 25/001
USPC ..... 347/8, 14, 15, 19, 41, 101, 104
See application file for complete search history.

(56) References Cited

U.S. PATENT DOCUMENTS 5,393,151 A * 2/1995 Martin et al. ..... 400/642
6,092,939 A 7/2000 Nishikori et al.
(Continued)

FOREIGN PATENT DOCUMENTS

CN 1413834 A 4/2003
CN 101092078 A 12/2007
(Continued)

OTHER PUBLICATIONS

Extended European Search Report dated Jul. 9, 2013 from related EP 12199732.4 from parent application U.S. Appl. No. 13/729,903.
(Continued)

*Primary Examiner* — Thinh Nguyen
(74) *Attorney, Agent, or Firm* — Scully, Scott, Murphy & Presser P.C.

(57) ABSTRACT

An inkjet printer is configured to acquire gap variation information related to a variation of a gap between a specific portion of an ink discharging surface and a recording sheet as a function of an inkjet head position, the specific portion located within a usage nozzle disposed area where usage nozzle rows to be actually used are disposed, determine representative gap variation information related to a variation, as a function of the inkjet head position, of a representative gap representing actual gaps between the usage nozzle rows and the recording sheet, by multiplying the gap variation information by a correction coefficient dependent on a width of the usage nozzle disposed area in a head moving direction and a wavelength of a wave shape of the recording sheet, and determine ink discharging timing based on the representative gap variation information, assuming that the actual gaps are equal to the representative gap.

20 Claims, 10 Drawing Sheets

(51) Int. Cl.

| | |
|---|---|
| ***B41J 11/00*** | (2006.01) |
| ***B41J 2/07*** | (2006.01) |
| ***B41J 25/308*** | (2006.01) |

(56) References Cited

U.S. PATENT DOCUMENTS

| | | | | |
|---|---|---|---|---|
| 6,310,637 | B1 | 10/2001 | Shimada et al. | |
| 6,896,432 | B2 * | 5/2005 | Ohyama | 400/642 |
| 8,104,864 | B2 | 1/2012 | Terada | |
| 8,197,056 | B2 | 6/2012 | Furukawa | |
| 2004/0126164 | A1 | 7/2004 | Ohyama | |
| 2004/0183841 | A1 | 9/2004 | Kunihiro | |
| 2005/0168557 | A1 | 8/2005 | Ohyama | |
| 2007/0229562 | A1 | 10/2007 | Doherty et al. | |
| 2008/0049058 | A1 | 2/2008 | Yakura et al. | |
| 2008/0150978 | A1 | 6/2008 | Sato et al. | |
| 2009/0262157 | A1 | 10/2009 | Sato et al. | |

FOREIGN PATENT DOCUMENTS

| | | | |
|---|---|---|---|
| EP | 0622227 | A2 | 4/1994 |
| JP | 2003-54078 | A | 2/2003 |
| JP | 2004-17586 | A | 1/2004 |
| JP | 2004-106978 | A | 4/2004 |
| JP | 3554184 | B2 | 8/2004 |
| JP | 2006-192814 | A | 7/2006 |
| JP | 2007-25492 | A | 2/2007 |
| JP | 2008-155423 | A | 7/2008 |
| JP | 2008-155424 | A | 7/2008 |
| JP | 2009-23121 | A | 2/2009 |
| JP | 2009-143152 | A | 7/2009 |
| JP | 2009-202430 | A | 9/2009 |

OTHER PUBLICATIONS

Notice of Allowance dated Dec. 24, 2013 from related application U.S. Appl. No. 13/729,903.

Notice of Allowance dated Jul. 7, 2014 from related application U.S. Appl. No. 14/228,445.

Notification of First Office Action dated Sep. 29, 2014 received from the Chinese Patent Office in corresponding application 201210586201.5 from related application U.S. Appl. No. 14/228,445, together with English language translation.

* cited by examiner

INKJET PRINTER AND METHOD FOR DETERMINING INK DISCHARGING TIMING

CROSS-REFERENCE TO RELATED APPLICATION

This application is a continuation application of U.S. Ser. No. 14/228,445 filed on Mar. 28, 2014, which is a continuation application of U.S. Ser. No. 13/729,903 filed on Dec. 28, 2012, now U.S. Pat. No. 8,714,681, and claims priority under 35 U.S.C. §119 from Japanese Patent Application No. 2012-082622 filed on Mar. 30, 2012. The entire subject matter of the application is incorporated herein by reference.

BACKGROUND

1. Technical Field

The following description relates to one or more techniques for determining ink discharging timing to discharge ink from nozzles onto a recording medium in an inkjet printer.

2. Related Art

As an example of inkjet printers configured to perform printing by discharging ink from nozzles onto a recording medium, an inkjet printer has been known that is configured to perform printing by discharging ink onto a recording sheet (a recording medium) from a recording head (an inkjet head) mounted on a carriage reciprocating along a predetermined head moving direction. Further, the known inkjet printer is configured to cause feed rollers or corrugated holding spur wheels to press the recording sheet against a surface of a platen that has thereon convex portions and concave portions alternately formed along the head moving direction, so as to deform the recording sheet in a predetermined wave shape. The predetermined wave shape has mountain portions protruding toward an ink discharging surface of the recording head, and valley portions recessed in a direction opposite to the direction toward the ink discharging surface, the mountain portions and the valley portions alternately arranged along the head moving direction.

SUMMARY

In the known inkjet printer, the gap between the ink discharging surface of the recording head and the recording sheet varies depending on portions (locations) on the recording sheet deformed in the wave shape (hereinafter, which may be referred to as a "wave-shaped recording sheet"). Therefore, when the known inkjet printer performs printing by discharging ink from the recording head onto the wave-shaped recording sheet with the same ink discharging timing as when performing printing on a recording sheet not deformed in such a wave shape, an ink droplet might land in a position deviated from a desired position on the recording sheet. Thus, it might result in a low-quality printed image. Further, in this case, the positional deviation value with respect to the ink landing position on the recording sheet varies depending on the portions (locations) on the recording sheet.

In view of the above problem, for instance, the following method is considered as a measure for discharging an ink droplet in a desired position on the wave-shaped recording sheet. The method is to adjust ink discharging timing (a moment) to discharge an ink droplet from the inkjet head depending on a gap between the ink discharging surface of the inkjet head and each individual portion of the mountain portions and the valley portions on the recording sheet.

Aspects of the present invention are advantageous to provide one or more improved techniques for an inkjet printer that make it possible to appropriately determine ink discharging timing to discharge ink from nozzles depending on a gap between an ink discharging surface of an inkjet head and each portion of mountain portions and valley portions on a recording sheet deformed in a wave shape.

According to aspects of the present invention, an inkjet printer is provided, which includes an inkjet head configured to discharge ink from a plurality of nozzles formed in an ink discharging surface thereof, the plurality of nozzles arranged in a plurality of nozzle rows along a first direction, the plurality of nozzle rows arranged along a second direction that is perpendicular to the first direction and parallel to the ink discharging surface, a head moving unit configured to move the inkjet head relative to a recording sheet along the second direction, a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions alternately arranged along the second direction, a gap variation acquiring device configured to acquire gap variation information related to a variation of a gap between a specific portion of the ink discharging surface and the recording sheet deformed in the predetermined wave shape as a function of a position of the inkjet head in the second direction, the specific portion located within a usage nozzle disposed area of the ink discharging surface where usage nozzle rows to be used in a printing operation, of the plurality of nozzle rows, are disposed, a first determining device configured to determine representative gap variation information related to a variation, as a function of the position of the inkjet head in the second direction, of a representative gap that represents respective gaps between the usage nozzle rows and the recording sheet deformed in the predetermined wave shape, by multiplying the acquired gap variation information by a correction coefficient that is dependent on a width of the usage nozzle disposed area in the second direction and a wavelength of the predetermined wave shape of the recording sheet, and a second determining device configured to determine ink discharging timing to discharge ink from the usage nozzle rows, based on the representative gap variation information determined by the first determining device, under an assumption that the respective gaps between the usage nozzle rows and the recording sheet deformed in the predetermined wave shape are equal to the representative gap.

According to aspects of the present invention, further provided is an inkjet printer that includes an inkjet head configured to discharge ink from a plurality of nozzles formed in an ink discharging surface thereof, the plurality of nozzles arranged in a plurality of nozzle rows along a first direction, the plurality of nozzle rows arranged along a second direction that is perpendicular to the first direction and parallel to the ink discharging surface, a head moving unit configured to move the inkjet head relative to a recording sheet along the second direction, a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions alternately arranged along the second direction, and a control device configured to acquire gap variation information related to a variation of a gap between a specific portion of the ink discharging surface and the recording sheet deformed in the predetermined wave shape as a function of a position of the inkjet head in the second direction, the specific portion located within a usage nozzle disposed area of the ink discharging surface where usage nozzle rows to be used in a printing operation, of the plurality of nozzle rows, are disposed, determine representative gap variation information related to a variation, as a function of the position of the inkjet head in the second direction, of a representative gap that represents respective gaps between the usage nozzle rows and the recording sheet deformed in the predetermined wave shape, by multiplying the acquired gap variation information by a correction coefficient that is dependent on a width of the usage nozzle disposed area in the second direction and a wavelength of the predetermined wave shape of the recording sheet, and determine ink discharging timing to discharge ink from the usage nozzle rows, based on the determined representative gap variation information, under an assumption that the respective gaps between the usage nozzle rows and the recording sheet deformed in the predetermined wave shape are equal to the representative gap.

According to aspects of the present invention, further provided is a method configured to be implemented on a control device connected with an inkjet printer, the inkjet printer including an inkjet head configured to discharge ink from a plurality of nozzles formed in an ink discharging surface thereof, the plurality of nozzles arranged in a plurality of nozzle rows along a first direction, the plurality of nozzle rows arranged along a second direction that is perpendicular to the first direction and parallel to the ink discharging surface, a head moving unit configured to move the inkjet head relative to a recording sheet along the second direction, and a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions alternately arranged along the second direction, the method including steps of acquiring gap variation information related to a variation of a gap between a specific portion of the ink discharging surface and the recording sheet deformed in the predetermined wave shape as a function of a position of the inkjet head in the second direction, the specific portion located within a usage nozzle disposed area of the ink discharging surface where usage nozzle rows to be used in a printing operation, of the plurality of nozzle rows, are disposed, determining representative gap variation information related to a variation, as a function of the position of the inkjet head in the second direction, of a representative gap that represents respective gaps between the usage nozzle rows and the recording sheet deformed in the predetermined wave shape, by multiplying the acquired gap variation information by a correction coefficient that is dependent on a width of the usage nozzle disposed area in the second direction and a wavelength of the predetermined wave shape of the recording sheet, and determining ink discharging timing to discharge ink from the usage nozzle rows, based on the determined representative gap variation information, under an assumption that the respective gaps between the usage nozzle rows and the recording sheet deformed in the predetermined wave shape are equal to the representative gap.

BRIEF DESCRIPTION OF THE ACCOMPANYING DRAWINGS

Figure 1:
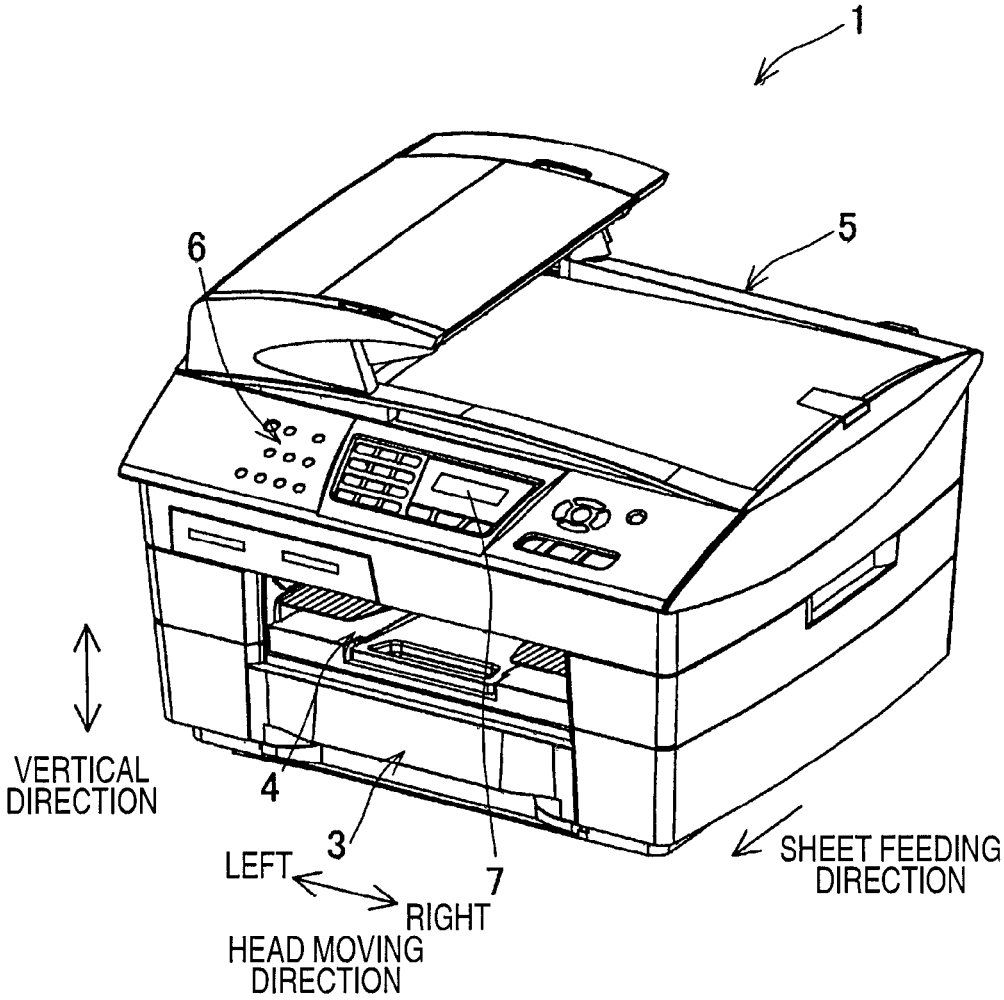
FIG. 1 is a perspective view schematically showing a configuration of an inkjet printer in an embodiment according to one or more aspects of the present invention.
Figure 2:
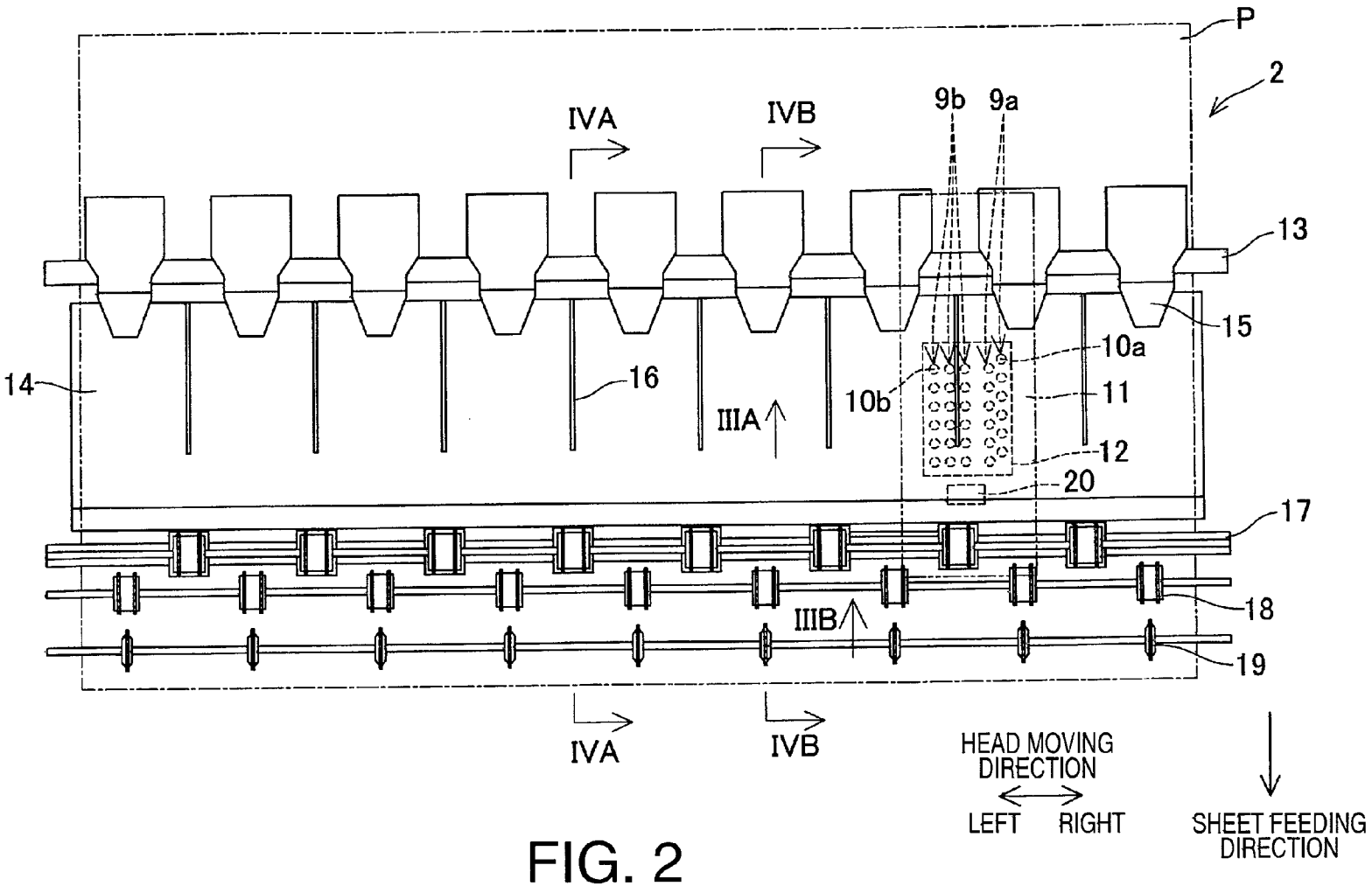
FIG. 2 is a top view of a printing unit of the inkjet printer in the embodiment according to one or more aspects of the present invention.
Figure 3A:
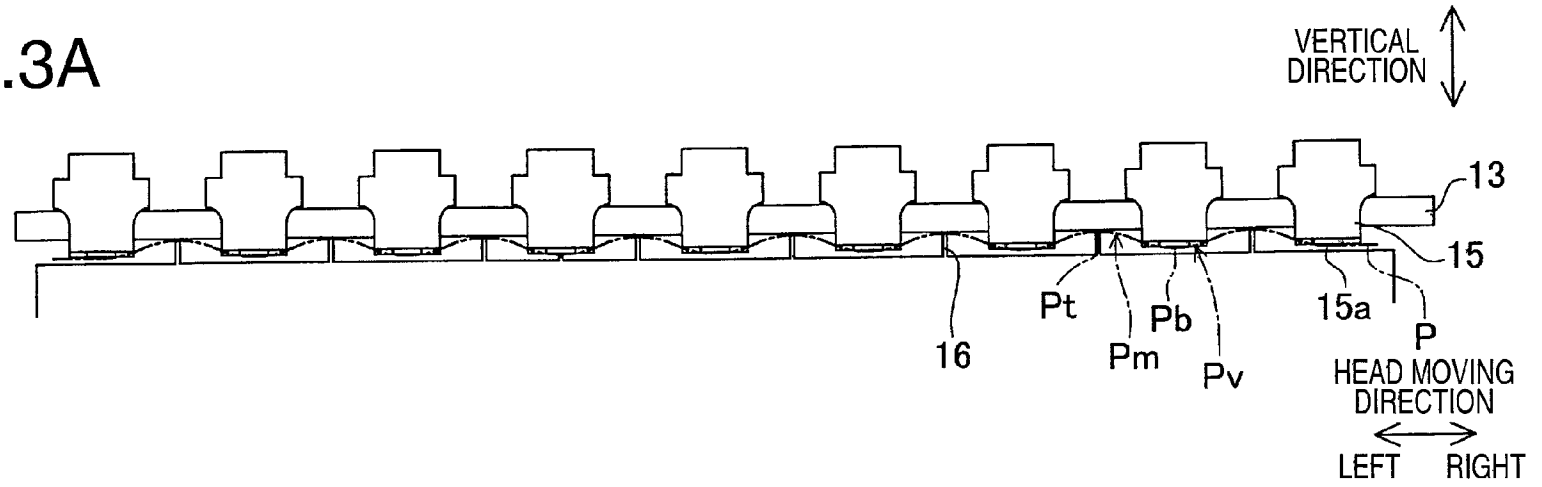

FIG. 3A schematically shows a part of the printing unit when viewed along an arrow IIIA shown in FIG. 2 in the embodiment according to one or more aspects of the present invention.

Figure 3B:
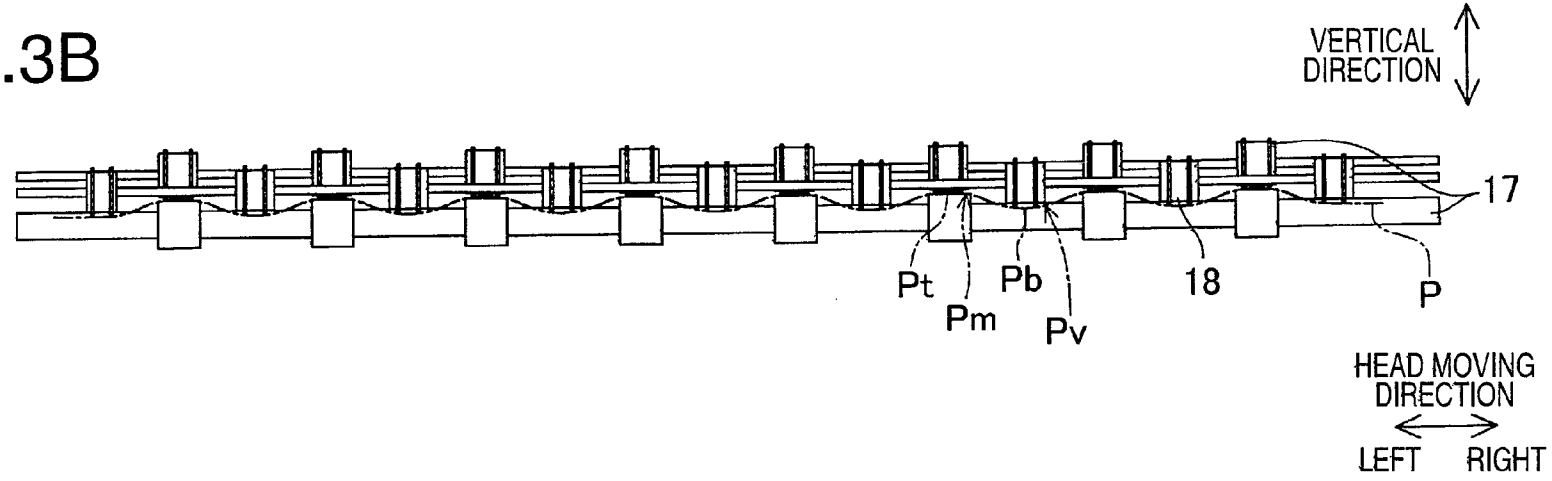

FIG. 3B schematically shows a part of the printing unit when viewed along an arrow IIIB shown in FIG. 2 in the embodiment according to one or more aspects of the present invention.

Figure 4A:
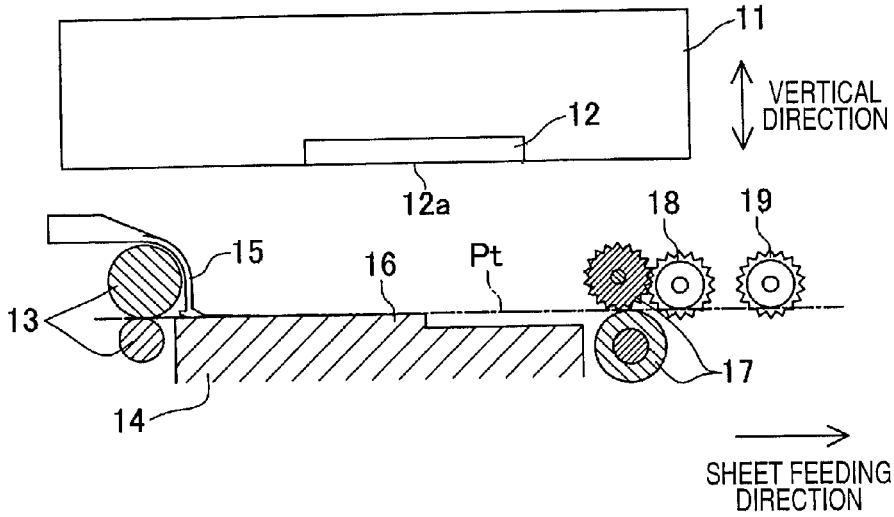

FIG. 4A is a cross-sectional view taken along a line IVA-IVA shown in FIG. 2 in the embodiment according to one or more aspects of the present invention.

Figure 4B:
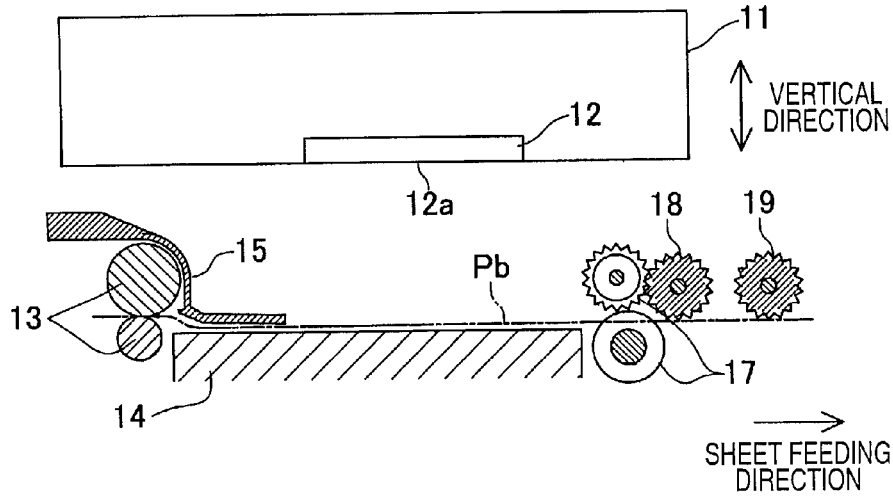

FIG. 4B is a cross-sectional view taken along a line IVB-IVB shown in FIG. 2 in the embodiment according to one or more aspects of the present invention.

Figure 5:
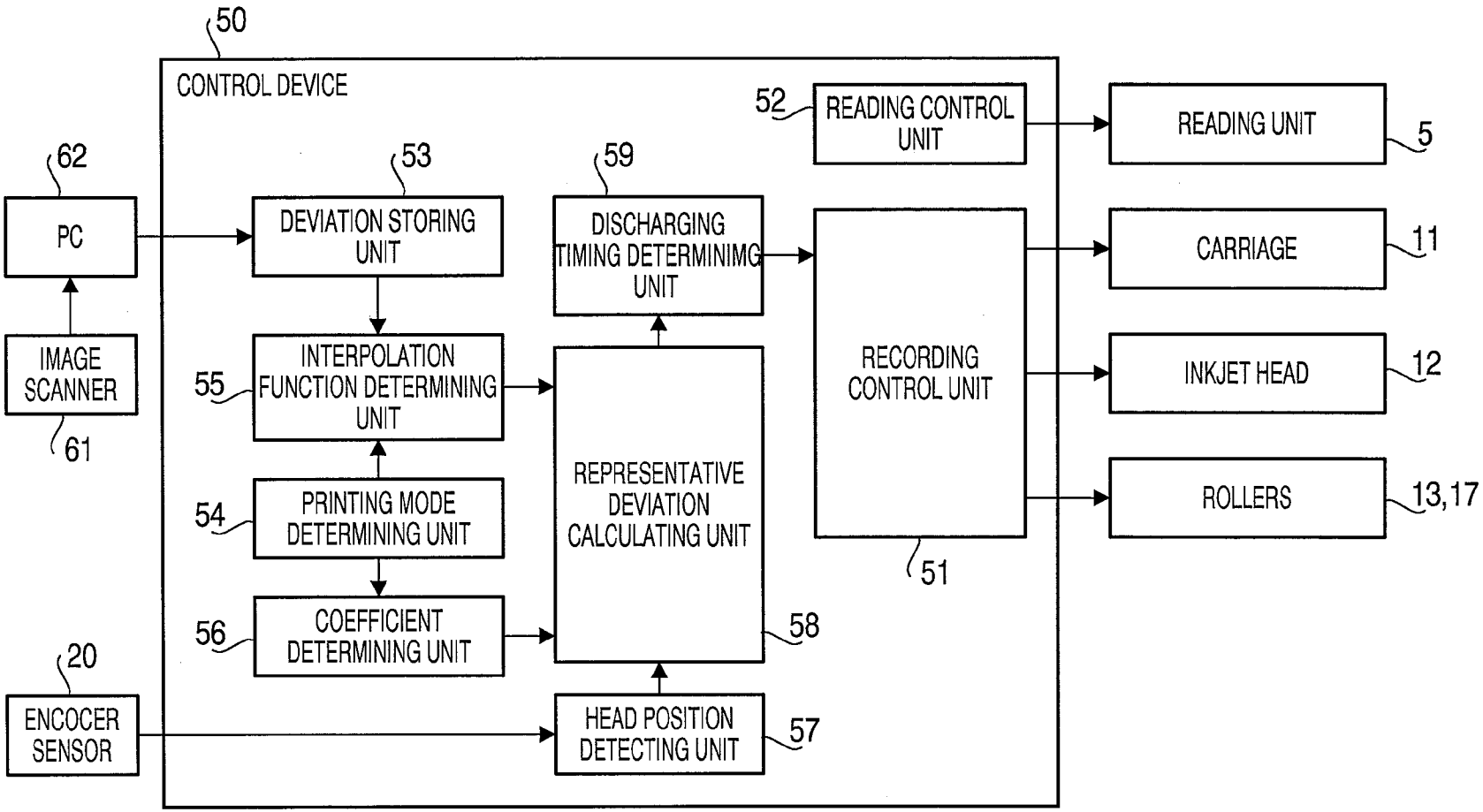

FIG. 5 is a functional block diagram of a control device of the inkjet printer in the embodiment according to one or more aspects of the present invention.

Figure 6:
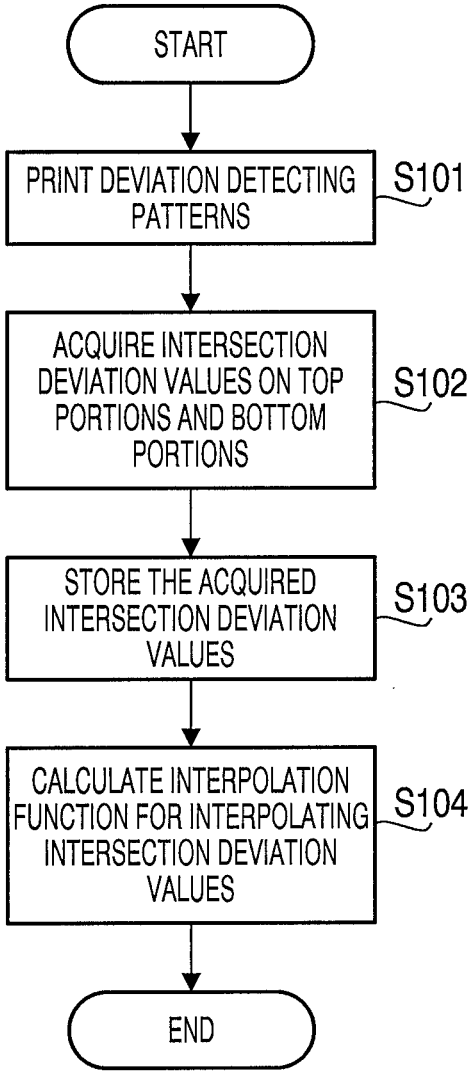

FIG. 6 is a flowchart showing a process to be executed in advance of a printing operation, in a procedure to determine ink discharging timing to discharge ink from nozzles in the inkjet printer, in the embodiment according to one or more aspects of the present invention.

Figure 7A:
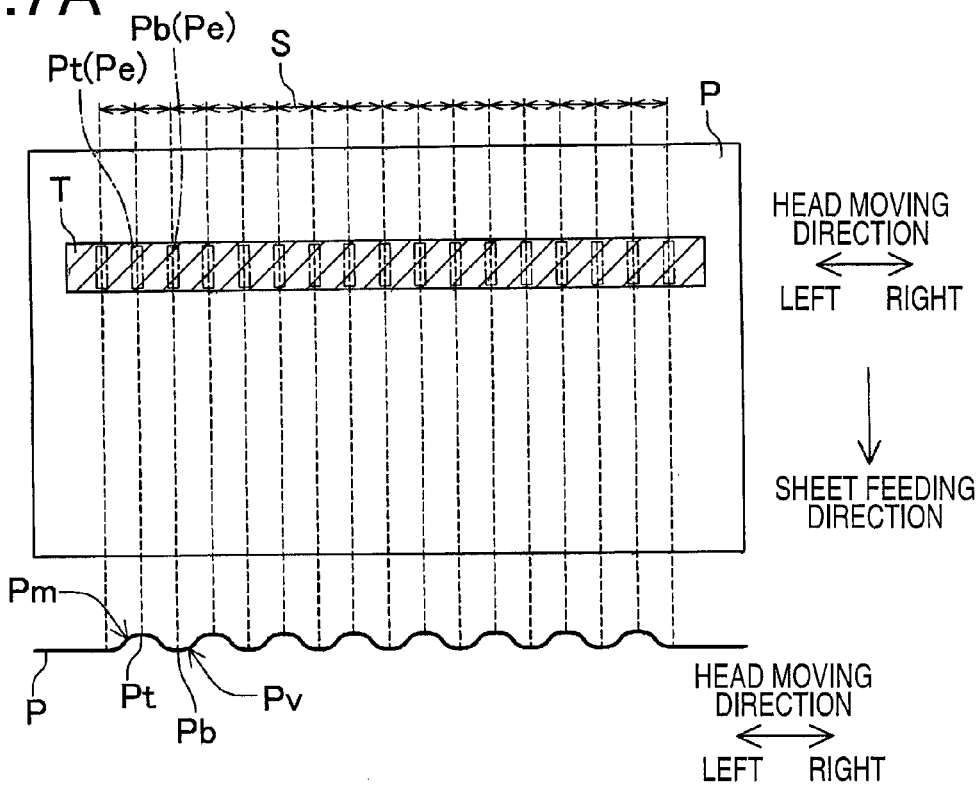

FIG. 7A shows sections to be read of a patch that includes a plurality of deviation detecting patterns printed on a recording sheet in the embodiment according to one or more aspects of the present invention.

Figure 7B:
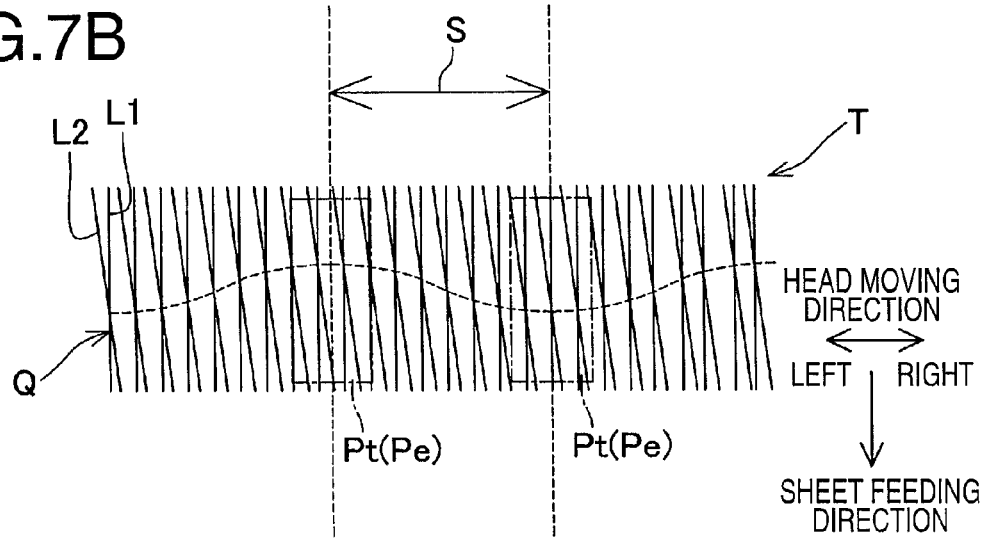

FIG. 7B is an enlarged view partially showing the patch that includes the plurality of deviation detecting patterns printed on the recording sheet in the embodiment according to one or more aspects of the present invention.

Figure 8A:
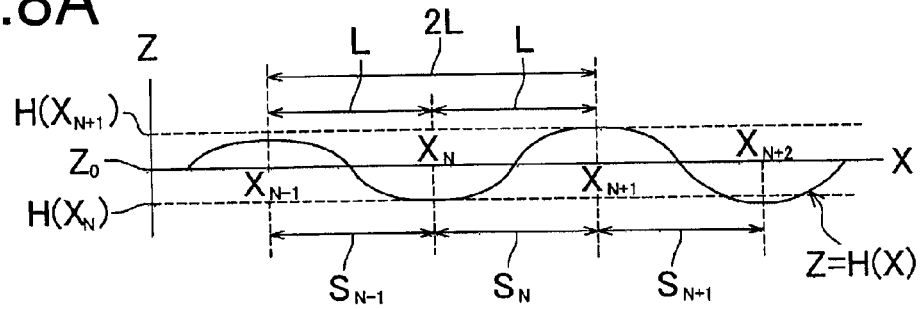

FIG. 8A shows a relationship between a position in a head moving direction on the recording sheet and the height of the recording sheet in the embodiment according to one or more aspects of the present invention.

Figure 8B:
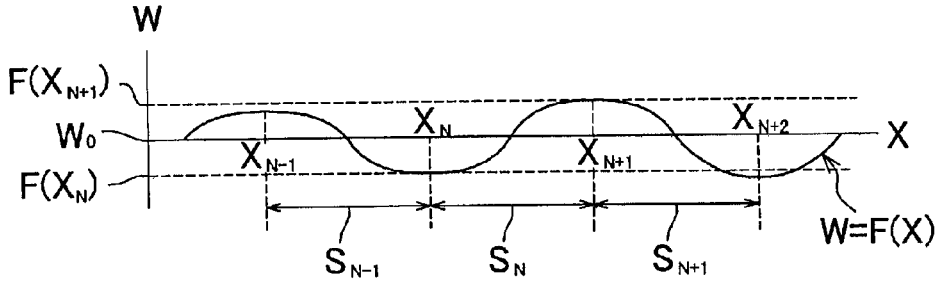

FIG. 8B shows a relationship between the position in the head moving direction on the recording sheet and a positional deviation value in the head moving direction of an ink droplet landing in the position on the recording sheet in the embodiment according to one or more aspects of the present invention.

Figure 8C:
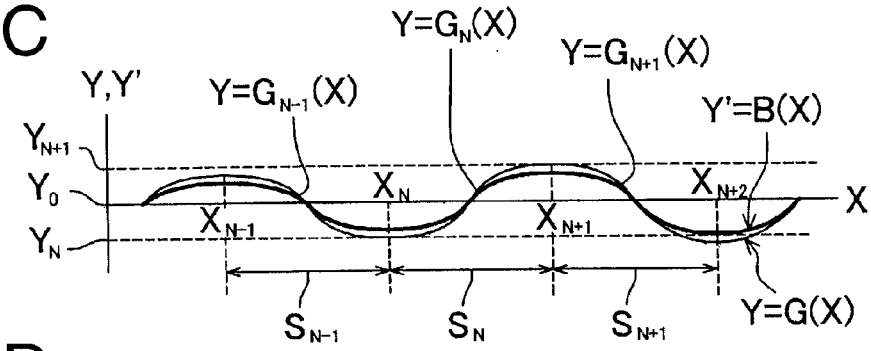

FIG. 8C shows a relationship between the position in the head moving direction on the recording sheet and an intersection deviation value in a sheet feeding direction of a pattern intersection formed on the recording sheet in the embodiment according to one or more aspects of the present invention.

Figure 8D:
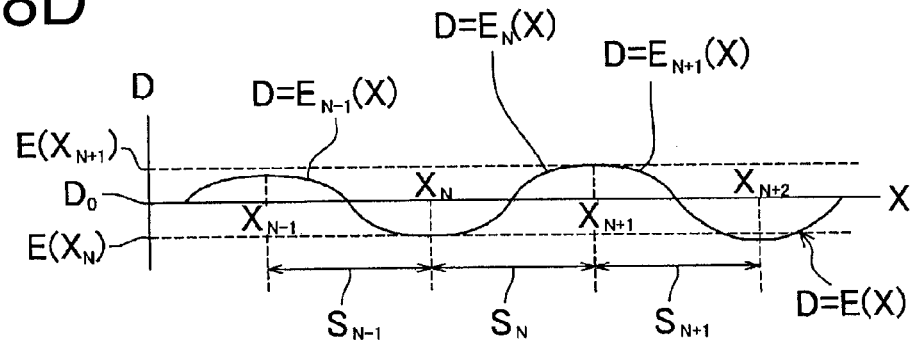

FIG. 8D shows a relationship between the position in the head moving direction on the recording sheet and a delay time for adjusting the ink discharging timing in the embodiment according to one or more aspects of the present invention.

Figure 9A:
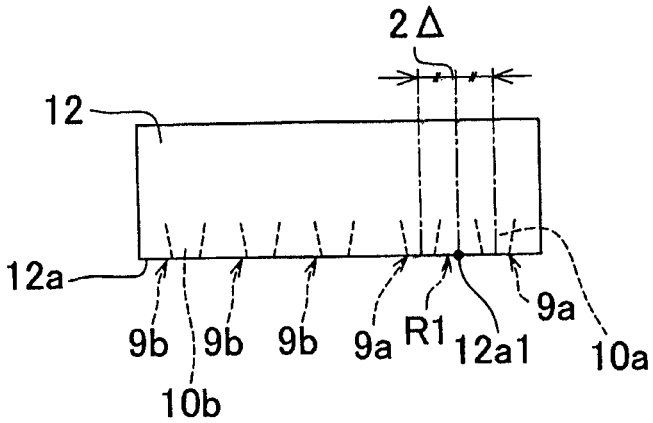

FIG. 9A schematically shows a position of a specific portion on an ink discharging surface of an inkjet head in a first printing mode in the embodiment according to one or more aspects of the present invention.

Figure 9B:
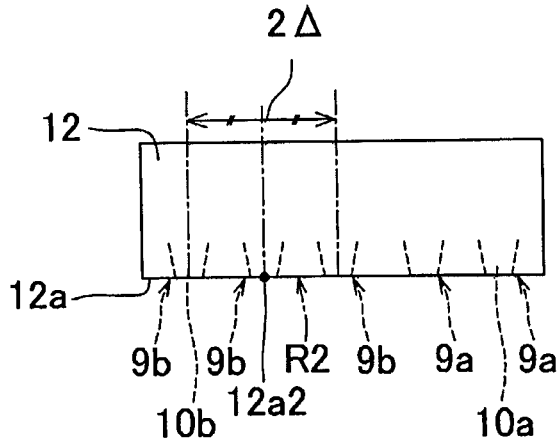

FIG. 9B schematically shows a position of the specific portion on the ink discharging surface of the inkjet head in a second printing mode in the embodiment according to one or more aspects of the present invention.

Figure 9C:
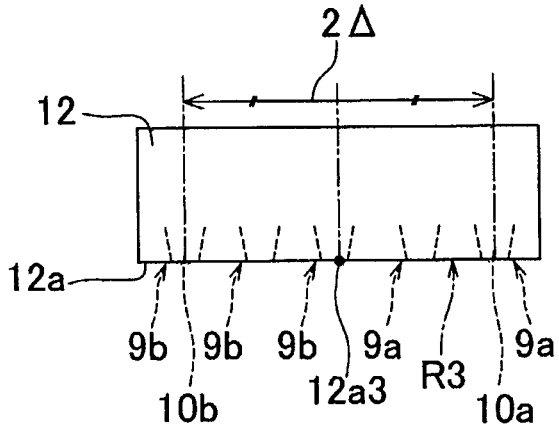

FIG. 9C schematically shows a position of the specific portion on the ink discharging surface of the inkjet head in a third printing mode in the embodiment according to one or more aspects of the present invention.

Figure 10:
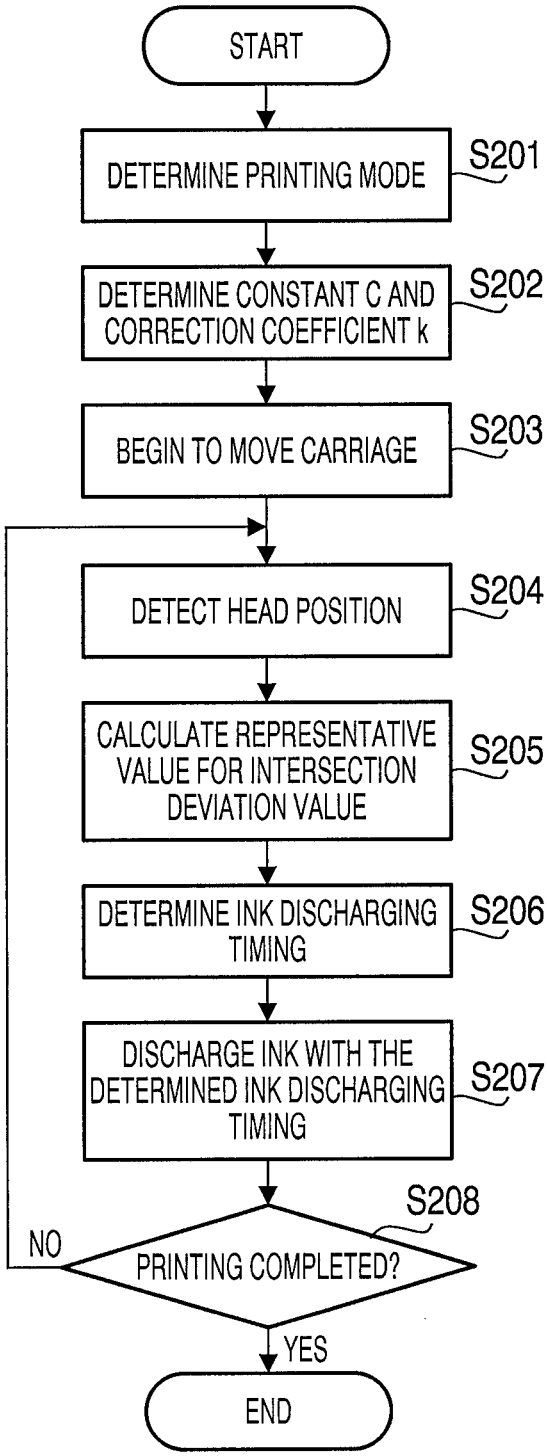

FIG. 10 is a flowchart showing a process to be executed in the printing operation, in the procedure to determine the ink discharging timing to discharge ink from the nozzles in the inkjet printer, in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described in detail with reference to the accompanying drawings.

An inkjet printer 1 of the embodiment is a multi-function peripheral having a plurality of functions such as a printing function to perform printing on a recording sheet P and an image reading function. The inkjet printer 1 includes a printing unit 2 (see FIG. 2), a sheet feeding unit 3, a sheet ejecting unit 4, a reading unit 5, an operation unit 6, and a display unit 7. Further, the inkjet printer 1 includes a control device 50 configured to control operations of the inkjet printer 1 (see FIG. 5).

The printing unit 2 is provided inside the inkjet printer 1. The printing unit 2 is configured to perform printing on the recording sheet P. A detailed configuration of the printing unit 2 will be described later. The sheet feeding unit 3 is configured to feed the recording sheet P to be printed by the printing unit 2. The sheet ejecting unit 4 is configured to eject the recording sheet P printed by the printing unit 2. The reading unit 5 is configured to be, for instance, an image scanner for reading images. The operation unit 6 is provided with buttons. A user is allowed to operate the inkjet printer 1 via the buttons of the operation unit 6. The display unit 7 is configured, for instance, as a liquid crystal display, to display information when the inkjet printer 1 is used.

Subsequently, the printing unit 2 will be described. As shown in FIGS. 2 to 4, the printing unit 2 includes a carriage 11, an inkjet head 12, feed rollers 13, a platen 14, a plurality of corrugated plates 15, a plurality of ribs 16, ejection rollers 17, and a plurality of corrugated spur wheels 18 and 19. It is noted that, for the sake of easy visual understanding in FIG. 2, the carriage 11 is indicated by a long dashed double-short dashed line, and portions disposed below the carriage 11 are indicated by solid lines.

The carriage 11 is configured to reciprocate along a guiderail (not shown) in a head moving direction. The inkjet head 12 is mounted on the carriage 11. The inkjet head 12 includes a plurality of black nozzles 10*a* and a plurality of color nozzles 10*b* formed in an ink discharging surface 12*a* that is a lower surface of the inkjet head 12. The plurality of black nozzles 10*a* are configured to discharge black ink therefrom. The plurality of color nozzles 10*b* are configured to discharge color ink therefrom.

The plurality of black nozzles 10*a* are arranged along a sheet feeding direction perpendicular to the head moving direction, so as to form two nozzle rows 9*a* arranged along the head moving direction in the ink discharging surface 12*a*. The plurality of color nozzles 10*b* are arranged along the sheet feeding direction at the left side of the nozzle rows 9*a* in the head moving direction, so as to form three nozzle rows 9*b* arranged along the head moving direction in the ink discharging surface 12*a*. The rightmost one of the three nozzle rows 9*b* in the head moving direction is configured to discharge yellow ink. The middle one of the three nozzle rows 9*b* in the head moving direction is configured to discharge cyan ink. The leftmost one of the three nozzle rows 9*b* in the head moving direction is configured to discharge magenta ink.

The feed rollers 13 are two rollers configured to pinch therebetween the recording sheet P fed by the sheet feeding unit 3 and feed the recording sheet P in the sheet feeding direction perpendicular to the head moving direction. The platen 14 is disposed to face the ink discharging surface 12*a*. The recording sheet P is fed by the feed rollers 13, along an upper surface of the platen 14.

The plurality of corrugated plates 15 are disposed to face an upper surface of an upstream end of the platen 14 in the sheet feeding direction. The plurality of corrugated plates 15 are arranged at substantially regular intervals along the head moving direction. The recording sheet P, fed by the feed rollers 13, passes between the platen 14 and the corrugated plates 15. At this time, pressing surfaces 15*a*, which are lower surfaces of the plurality of corrugated plates 15, press the recording sheet P from above.

Each individual rib 16 is disposed between corresponding two mutually-adjacent corrugated plates 15 in the head moving direction, on the upper surface of the platen 14. The plurality of ribs 16 are arranged at substantially regular intervals along the head moving direction. Each rib 16 protrudes from the upper surface of the platen 14 up to a level higher than the pressing surfaces 15*a* of the corrugated plates 15. Each rib 16 extends from an upstream end of the platen 14 toward a downstream side in the sheet feeding direction. Thereby, the recording sheet P on the platen 14 is supported from underneath by the plurality of ribs 16.

The ejection rollers 17 are two rollers configured to pinch therebetween portions of the recording sheet P that are located in the same positions as the plurality of ribs 16 in the head moving direction and feed the recording sheet P toward the sheet ejecting unit 4. An upper one of the ejection rollers 17 is provided with spur wheels so as to prevent the ink attached onto the recording sheet P from transferring to the upper ejection roller 17.

The plurality of corrugated spur wheels 18 are disposed substantially in the same positions as the corrugated plates 15 in the head moving direction, at a downstream side relative to the ejection rollers 17 in the sheet feeding direction. The plurality of corrugated spur wheels 19 are disposed substantially in the same positions as the corrugated plates 15 in the head moving direction, at a downstream side relative to the corrugated spur wheels 18 in the sheet feeding direction. In addition, the plurality of corrugated spur wheels 18 and 19 are placed at a level lower than a position where the ejection rollers 17 pinch the recording sheet P therebetween, in the vertical direction. The plurality of corrugated spur wheels 18 and 19 are configured to press the recording sheet P from above at the level. Further, each of the plurality of corrugated spur wheels 18 and 19 is not a roller having a flat outer circumferential surface but a spur wheel. Therefore, it is possible to prevent the ink attached onto the recording sheet P from transferring to the plurality of corrugated spur wheels 18 and 19.

Thus, the recording sheet P on the platen 14 is pressed from above by the plurality of corrugated plates 15 and the plurality of corrugated spur wheels 18 and 19, and is supported from underneath by the plurality of ribs 16. Thereby, as shown in FIG. 3, the recording sheet P on the platen 14 is bent and deformed in such a wave shape that mountain portions Pm protruding upward (i.e., toward the ink discharging surface 12*a*) and valley portions Pv recessed downward (i.e., in a direction opposite to the direction toward the ink discharging surface 12*a*) are alternately arranged. Further, each mountain portion Pm has a top portion (peak portion) Pt, protruding up to the highest position of the mountain portion Pm, which is located substantially in the same position as the center of the corresponding rib 16 in the head moving direction. Each valley portion Pv has a bottom portion Pb, recessed down to the lowest position of the valley portion Pv, which is located substantially in the same position as the corresponding corrugated plate 15 and the corresponding corrugated spur wheels 18 and 19.

An encoder sensor 20 is mounted on the carriage 11. The encoder sensor 20 and an encoder belt (not shown) extending along the head moving direction form a linear encoder. The encoder sensor 20 is configured to detect slits formed in the encoder belt and thereby detect the position of the inkjet head 12 moving together with the carriage 11 along the head moving direction.

The printing unit 2 configured as above performs printing on the recording sheet P, by discharging ink from the inkjet head 12 reciprocating together with the carriage 11 along the head moving direction while feeding the recording sheet P in the sheet feeding direction by the feed rollers 13 and the ejection rollers 17. At this time, the printing unit 2 performs printing in a selected one of a first printing mode, a second printing mode, and a third printing mode. In the first printing mode, the printing unit 2 performs printing by discharging ink only from the black nozzles 10*a*. In the second printing mode, the printing unit 2 performs printing by discharging ink only from the color nozzles 10*b*. In the third printing mode, the printing unit 2 performs printing by discharging ink from both the black nozzles 10*a* and the color nozzles 10*b*.

Next, an explanation will be provided about the control device 50 for controlling the operations of the inkjet printer 1. The control device 50 includes a central processing unit (CPU), a read only memory (ROM), a random access memory (RAM), and control circuits. The control device 50 is configured to function as various elements such as a recording control unit 51, a reading control unit 52, a deviation storing unit 53, a printing mode determining unit 54, an interpolation function determining unit 55, a coefficient determining unit 56, a head position detecting unit 57, a representative deviation calculating unit 58, and a discharging timing determining unit 59 (see FIG. 5).

The recording control unit 51 is configured to control operations of the carriage 11, the inkjet head 12, the feed rollers 13, and the ejection rollers 17 when the inkjet printer 1 performs a printing operation. The reading control unit 52 is configured to control operations of the reading unit 5 in image reading.

As will be described later, the deviation storing unit 53 is configured to store (retain) a deviation value (hereinafter, which may be referred to as an intersection deviation value) in the sheet feeding direction of an intersection between two lines of a deviation detecting pattern formed on each individual portion of the plurality of top portions Pt and the plurality of bottom portions Pb. The intersection deviation value will be described later. The printing mode determining unit 54 is configured to determine which one of the first to third printing modes is to be employed to perform the printing operation, based on data of an image to be printed and user operations of the operation unit 6.

The interpolation function determining unit 55 is configured to determine an interpolation function for interpolating intersection deviation values over a whole wave-shaped area of the recording sheet P in the head moving direction, based on the intersection deviation values stored in the deviation storing unit 53 and the printing mode determined by the printing mode determining unit 54. As will be described later, the coefficient determining unit 56 is configured to determine a correction coefficient k ($0 \leq k \leq 1$) necessary for the representative deviation calculating unit 58 to calculate a representative value for the intersection deviation value.

The head position detecting unit 57 is configured to detect the position of the inkjet head 12 reciprocating together with the carriage along the head moving direction, from the detection result of the encoder sensor 20. As will be described later, the representative deviation calculating unit 58 is configured to calculate the representative value for the intersection deviation value on each portion of the recording sheet P based on the interpolation function determined by the interpolation function determining unit 55, the correction coefficient k determined by the coefficient determining unit 56, and the position of the inkjet head 12 detected by the head position detecting unit 57. The discharging timing determining unit 59 is configured to determine ink discharging timing (moments) to discharge ink from the nozzles 10, based on the representative value for the intersection deviation value calculated by the representative deviation calculating unit 58.

Subsequently, an explanation will be provided about a procedure to determine the ink discharging timing to discharge ink from the nozzles 10 and perform a printing operation in the inkjet printer 1. In order to determine the ink discharging timing and perform the printing operation, below-mentioned steps S101 to S104 shown in FIG. 6 are previously executed before the user performs the printing operation using the inkjet printer 1, e.g., at a stage of manufacturing the inkjet printer 1. Then, below-mentioned steps S201 to S208 shown in FIG. 10 are executed when the user performs the printing operation using the inkjet printer 1.

In S101, the control device 50 controls the printing unit 2 to print on the recording sheet P a patch T, which includes a plurality of deviation detecting patterns Q as shown in FIGS. 7A and 7B. More specifically, for instance, the control device 50 controls the printing unit 2 to print a plurality of straight lines L1, which extend in parallel with the sheet feeding direction and are arranged along the head moving direction, by discharging ink from the nozzles 10 while moving the carriage 11 toward one side along the head moving direction. After that, the control device 50 controls the printing unit 2 to print a plurality of straight lines L2, which are tilted with respect to the sheet feeding direction and intersect the plurality of straight lines L1, respectively, by discharging ink from the nozzles 10 while moving the carriage 11 toward the other side along the head moving direction. Thereby, as shown in FIGS. 7A and 7B, the patch T is printed that includes the plurality of deviation detecting patterns Q arranged along the head moving direction, each deviation detecting pattern Q including a combination of the mutually intersecting straight lines L1 and L2. It is noted that, at this time, ink droplets are discharged from the nozzles 10 in accordance with design-based ink discharging timing that is determined, for example, based on an assumption that the recording sheet P is not in the wave shape but flat.

In S102, an image scanner 61, which is provided separately from the inkjet printer 1, is caused to read the plurality of deviation detecting patterns Q printed in S101. Further, in S102, a PC 62, which is connected with the image scanner 61, is caused to acquire the intersection deviation value on each individual portion of the plurality of top portions Pt and the plurality of bottom portions Pb, from the read deviation detecting patterns Q.

More specifically, for example, when the deviation detecting patterns Q as shown in FIGS. 7A and 7B are printed in a situation where there is a deviation between the ink landing position in the rightward movement of the carriage 11 along the head moving direction and the ink landing position in the leftward movement of the carriage 11 along the head moving direction, the straight line L1 and the straight line L2 of a deviation detecting pattern Q are printed to be deviated from each other in the head moving direction. Therefore, the straight line L1 and the straight line L2 form an intersection thereof (hereinafter referred to as a pattern intersection) in a position deviated from the center of the straight lines L1 and L2 in the sheet feeding direction depending on the positional deviation value in the head moving direction between the ink landing positions. Further, when the reading unit 5 reads each deviation detecting pattern Q, the reading unit 5 detects a higher brightness at the pattern intersection than the brightness at any other portion of the read deviation detecting pattern Q. This is because the ratio of the areas (black) of the straight lines L1 and L2 relative to the background areas (white) of the recording sheet P is smaller at the pattern intersection than at any other portion. Accordingly, by reading each deviation detecting pattern Q and acquiring a position where the highest brightness is detected within the read deviation detecting pattern Q, it is possible to detect the position of the intersection of the straight lines L1 and L2 in the sheet feeding direction.

A positional deviation in the sheet feeding direction of the intersection of the straight lines L1 and L2 is proportional to a positional deviation in the head moving direction of the intersection of the straight lines L1 and L2. Specifically, when a relative slope between the straight lines L1 and L2 is described by a ratio of "the component in the sheet feeding direction:the component in the head moving direction" equal to "10:1," the positional deviation in the sheet feeding direction of the intersection of the straight lines L1 and L2 is ten times as large as the positional deviation in the head moving direction of the intersection of the straight lines L1 and L2. In general, when an angle between the straight lines L1 and L2 is θ, the positional deviation in the sheet feeding direction of the intersection of the straight lines L1 and L2 is 1/tan times as large as the positional deviation in the head moving direction of the intersection of the straight lines L1 and L2. Thus, by detecting an intersection deviation value of a pattern intersection in the sheet feeding direction, it is possible to acquire information on a positional deviation value with respect to the ink landing position in the main scanning direction (i.e., the head moving direction) in bidirectional printing.

In the embodiment, the intersection deviation value on each individual portion of the top portions Pt and the bottom portions Pb is acquired by reading deviation detecting patterns Q printed on the corresponding portion of the top portions Pt and the bottom portions Pb of the recording sheet P (see sections surrounded by alternate long and short dash lines in FIG. 7A, which may hereinafter be referred to as examined sections Pe).

As described above, in S102, the image scanner 61 is caused to read only the deviation detecting patterns Q printed on the top portions Pt and the bottom portions Pb of the recording sheet P. Therefore, in S101, the control device 50 may control the printing unit 2 to print the deviation detecting patterns Q at least on the top portions Pt and the bottom portions Pb of the recording sheet P.

In S103, as indicated by a dashed line in FIG. 5, the deviation storing unit 53 is communicably connected with the PC 62, and is caused to store the intersection deviation value, acquired in S102, on each individual portion of the top portions Pt and the bottom portions Pb. It is noted that the connection between the deviation storing unit 53 and the PC 62 may be established at any time before S103.

In S104, the control device 50 (the interpolation function determining unit 55) determines an interpolation function G(X) for calculating intersection deviation values over the whole wave-shaped area of the recording sheet P in the head moving direction, from the intersection deviation values on the top portions Pt and the bottom portions Pb stored in the deviation storing unit 53 in S103.

When the recording sheet P is deformed in the wave shape along the head moving direction as described above, the wave shape is expressed as shown in FIG. 8A using a position X in the head moving direction (the horizontal axis) and a height Z in the vertical direction (the vertical axis). Here, "$X_N$" represents a position of an N-th examined section Pe in the head moving direction. "$S_N$" represents a segment from "$X=X_N$" to "$X=X_{N+1}$." Further, "L," which represents a width of each segment, is expressed as "$L=X_{N+1}-X_N$" and is constant regardless of the value of "N." At this time, the height Z of the recording sheet P in the segment $S_N$ is expressed as "$Z=H_N(X)$" using "$H_N(X)$" that is a function of "X." A function, defined by the functions $H_N(X)$ with respect to all values for "N" being joined throughout all segments, is expressed as "Z=H(X)."

FIG. 8B shows a positional deviation value W of the ink landing position in the head moving direction (the vertical axis), which is expressed as "W=F(X)" as a function of the position X in the head moving direction (the horizontal axis). In the following description, "$W_0$" represents a deviation of the ink landing position in the head moving direction in the case of "$Z=Z_0$." According to an equation "(the moving distance of an ink droplet)=(the velocity of the ink droplet)×(the flying time of the ink droplet)," since the ink droplet moves in the vertical direction and the head moving direction within the same flying time, the following equation is established: "(the moving distance of the ink droplet in the vertical direction)/(the velocity of the ink droplet in the vertical direction)=(the moving distance of the ink droplet in the head moving direction)/(the velocity of the ink droplet in the head moving direction)." Namely, the equation "$(Z-Z_0)/U=(W-W_0)/V$" is established, where "V" represents the speed of the carriage 11 in the head moving direction, and "U" represents the flying velocity of the ink droplet in the vertical direction. Here, "$Z_0$," "$W_0$" "U," and "V" are constant values that do not depend on the value of "X." Therefore, the functions "Z=H(X)" and "W=F(X)" provide substantially similar wave shapes. Further, FIG. 8C shows an intersection deviation value Y of the pattern intersection in the sheet feeding direction (the vertical axis), which is expressed as "Y=G(X)" as a function of the position X in the head moving direction (the horizontal axis). As described above, since Y=W/tan θ, the function "Y=G(X)" provides a wave shape similar to the wave shapes of "Z=H(X)" and "W=F(X)."

Accordingly, as shown in FIG. 8B, the variation of the positional deviation value W of the ink landing position in the head moving direction as a function of the position X in the head moving direction is expressed as a graph that can be rendered coincident with a graph for representing the variation of the height Z of the recording sheet P by scaling and translation along the vertical axis. Likewise, as shown in FIG. 8C, the variation of the intersection deviation value Y of the pattern intersection in the sheet feeding direction as a function of the position X in the head moving direction is expressed as a graph that can be rendered coincident with a graph for representing the variation of the height Z of the recording sheet P by scaling and translation along the vertical axis. Namely, the graph of the interpolation function G(X) for the intersection deviation value Y is transformable into the graph of the interpolation function H(X) for the height Z and the graph of the interpolation function F(X) for the positional deviation value W of the ink landing position by scaling and translation along the vertical axis.

The same applies to a below-mentioned graph shown in FIG. 8D (which represents the variation of a delay time for adjusting the ink discharging timing). The four pieces of information (the four functions) shown in FIGS. 8A to 8D are substantially equivalent when the respective relevant constant values are known. Therefore, even when the deviation storing unit 53 stores any one of the four functions, or interpolation calculation is made using any one of the four functions, it is possible to correct the positional deviation value with respect to the ink landing position through appropriate transformation between the functions. In the embodiment, the following description will be provided based on an assumption that the deviation storing unit 53 stores the intersection deviation values Y.

The interpolation function G(X) is calculated for each individual one of the segments into which the patch T is partitioned by the examined sections Pe in the head moving direction. An interpolation function $G_N(X)$ represents an interpolation function for the intersection deviation values Y (the positional deviations of the pattern intersections in the sheet feeding direction) within a segment $S_N$ defined by two ends, i.e., the N-th examined section Pe and the (N+1)-th examined section Pe from the left side in the head moving direction. When the positions in the head moving direction of the N-th examined section Pe and the (N+1)-th examined section Pe from the left side in the head moving direction are "$X_N$" and "$X_{N+1}$," respectively, according to relationship with the intersection deviation values Y stored in the deviation storing unit 53 in S103, the interpolation function $G_N(X)$ needs to satisfy the following two conditional expressions.

$$G_N(X_N)=Y_N$$

$$G_N(X_{N+1})=Y_{N+1} \qquad \text{(Expression 1)}$$

where $Y_N$ represents the intersection deviation value on the examined section Pe of the position "$X=X_N$," and $Y_{N+1}$ represents the intersection deviation value on the examined section Pe of the position "$X=X_{N+1}$."

Further, in order to continuously and smoothly connect the interpolation function $G_N(X)$ with the interpolation functions $G_{N-1}(X)$ and $G_{N+1}(X)$ of the adjacent segments $S_{N-1}$ and $S_{N+1}$, the interpolation function $G_N(X)$ needs to have first derivatives with respect to "X" that are continuous with the first derivatives with respect to "X" of the interpolation functions $G_{N-1}(X)$ and $G_{N+1}(X)$ on the corresponding bottom portion Pb and the corresponding top portion Pt, respectively. Further, at each of the both ends of each individual segment S, the interpolation function G(X) (the wave shape) has a local minimum value (a bottom) or a local maximum value (a top). Therefore, at each end of each individual segment S, the interpolation function G(X) has a first derivative equal to "0." Accordingly, the first derivative $G'_N(X)$ of the interpolation function $G_N(X)$ with respect to "X" has only to satisfy the following two conditional expressions.

$$G(X_N)=0$$

$$G(X_{N+1})=0 \qquad \text{(Expressions 2)}$$

The polynomial expression for the interpolation function $G_N(X)$ with respect to the coordinate X in the head moving direction of the recording sheet P is determined with the aforementioned four conditional expressions as boundary conditions. Hence, the interpolation function $G_N(X)$ is represented by the following cubic function satisfying the aforementioned four conditional expressions.

$$G_N(X) = \frac{Y_{N+1}-Y_N}{L^2}(X+C-X_N)^2(2(X+C-X_N)-3L)+Y_N \qquad \text{(Expression 3)}$$

In the expression 3, "L" represents ($X_{N+1}-X_N$), which is equal to half the wavelength of the wave shape of the recording sheet P. Here, since the corrugated plates 15, the ribs 16, and the corrugated spur wheels 18 and 19 are arranged at substantially regular intervals along the head moving direction, respectively, the wavelength of the wave shape of the recording sheet P, which is equal to "2L," is constant. Further, as will be described later, "C" is a constant determined depending on the printing mode. Nonetheless, at this stage, since the printing mode is not determined, the constant C is not determined.

The interpolation function $G_N(X)$ is an interpolation function for the intersection deviation value Y. In the expression 3, even though "$Y_{N+1}$," "$Y_N$," and "$G_N(X)$" are replaced with "$Y_{N+1}-Y_0$," "$Y_N-Y_0$," and "$G_N(X)-Y_0$," respectively, the equality holds with respect to any value for "$Y_0$" (regardless of the value of "$Y_0$"). Namely, the following relationship is established.

$$G_N(X) = \frac{(Y_{N+1}-Y_0)-(Y_N-Y_0)}{L^2}(X-X_N)^2 \{2(X+C-X_N)-3L\}+(Y_N-Y_0)+Y_0 \qquad \text{(Expression 4)}$$

The above function (equation) may be used as a function for determining the absolute value of an intersection deviation value in an arbitrary position by substituting the absolute values of acquired intersection deviation values into the equation. Further, the above function may be used as a function for determining the deviation of an intersection deviation value in an arbitrary position from a certain value ($Y_0$) by substituting the deviations of acquired intersection deviation values from the certain value into the equation. Accordingly, intersection deviation values to be stored in the deviation storing unit 53, which are local maximum values and local minimum values of the function Y=G(X), may be represented by deviations from any value for "$Y_0$." In the embodiment, the average value of "Y" throughout all the segments is employed as "$Y_0$."

In S201, the control device 50 (the printing mode determining unit 54) determines in which mode of the first to third printing mode the printing operation is to be performed. In S202, based on the printing mode determined in S201, the control device 50 (the coefficient determining unit 56) determines the value of the constant C and the correction coefficient k in the interpolation function G(X).

Hereinafter, a more detailed explanation will be provided about determination of the constant C. The gap between the ink discharging surface 12*a* and the recording sheet P differs depending on the position on the ink discharging surface 12*a* in the head moving direction. Accordingly, the gap between the ink discharging surface 12*a* and the recording sheet P differs between an area of the ink discharging surface 12*a* where the nozzle rows 9*a* are formed and an area of the ink discharging surface 12*a* where the nozzle rows 9*b* are formed.

Meanwhile, the aforementioned interpolation function H(X) is related to the gap between a specific portion of the ink discharging surface 12*a* and the recording sheet P. Further, the interpolation function G(X) represents the intersection deviation value(s) under an assumption that the nozzles are formed in the specific portion. The constant C represents a distance in the head moving direction between a particular portion that represents the nozzle rows used for printing the patch T and the specific portion that represents the nozzle rows to be used in the printing mode for which the variation of the gap between the ink discharging surface 12*a* and the recording sheet P is to be estimated using the interpolation functions. By translating the interpolation function G(X) along the X axis, that is, by changing the value of the constant C, the position of the specific portion is changed.

At this time, if the value of the constant C is determined individually for each of a case where the area of the ink discharging surface 12*a* where the nozzle rows 9*a* are formed is set to be the specific portion and a case where the area of the ink discharging surface 12*a* where the nozzle rows 9*b* are formed is set to be the specific portion, the interpolation function G(X) is acquired individually for each of the nozzle rows 9*a* and the nozzle rows 9*b*. The acquired interpolation functions G(X) represent the intersection deviation values with respect to the nozzle rows 9*a* and the nozzle rows 9*b*, respectively.

However, in this case, as will be described later, when the ink discharging timing is determined based on the interpolation function G(X), the ink discharging timing (a delay time from the design-based ink discharging moment) needs to be determined independently for each of the nozzle rows 9*a* and the nozzle rows 9*b*. Discharging ink from the nozzle rows 9*a* and the nozzle rows 9*b* with the respective different delay times requires a complicated electrical system, e.g., for wiring the inkjet head 12.

In the embodiment, as the nozzle rows to be used are changed depending on which mode of the first to third printing mode is selected for the printing operation, the constant C is set for each individual printing mode. Then, the intersection deviation values determined using the interpolation function G(X) with the determined constant C are regarded as intersection deviation values to be applied in common to all the nozzles to be used. At this time, the constant C is determined in such a manner that the specific portion is set in a central position in the head moving direction of an area (a usage nozzle disposed area) between a leftmost nozzle row and a rightmost nozzle row of the nozzles to be used.

Specifically, in the first printing mode to use only the black nozzles 10*a*, as shown in FIG. 9A, the constant C is determined in such a manner that the specific portion is set in a central position 12*a* 1 in the head moving direction of an area R1 (a usage nozzle disposed area) between the two nozzle rows 9*a*. Further, in the second printing mode to use only the color nozzles 10*b*, as shown in FIG. 9B, the constant C is determined in such a manner that the specific portion is set in a central position 12*a*2 in the head moving direction of an area R2 (a usage nozzle disposed area) between the leftmost and rightmost ones of the three nozzle rows 9*b* in the head moving direction. In addition, in the third printing mode to use both the black nozzles 10*a* and the color nozzles 10*b*, as shown in FIG. 9C, the constant C is determined in such a manner that the specific portion is set in a central position 12*a*3 in the head moving direction of an area R3 (a usage nozzle disposed area) between the leftmost nozzle row 9*b* and the rightmost nozzle row 9*a* of all the nozzle rows 9*a* and 9*b* in the head moving direction.

When the specific portion is located an even distance away from the both ends of the usage nozzle disposed area in the head moving direction, it is possible to achieve the minimum distance between the specific portion and the farthest one of the nozzles to be used. Therefore, when the specific portion is set in the central position of the usage nozzle disposed area in the head moving direction, it is possible to achieve the minimum difference between the gap between each nozzle row to be used and the recording sheet P and the gap between the specific portion and the recording sheet P, under the condition that the nozzles within the usage nozzle disposed area are used for the printing operation. Namely, it is possible to achieve the minimum difference between the intersection deviation values determined based on the interpolation function G(X) and actual intersection deviation values.

When the width of the usage nozzle disposed area (the area R1, R2, or R3) in the head moving direction is represented by 2Δ, and the ratio of the width 2Δ to the wavelength 2L is represented by p(=Δ/L), the correction coefficient k is set as $k=1+2p^3-3p^2$. An explanation will be provided later about why the correction coefficient k is set as such an expression.

The steps S201 and S202 are executed before the carriage 11 begins to be moved and the inkjet head 12 begins to discharge ink. After completion of S202, in S203, the carriage 11 begins to be moved.

In S204, during the movement of the carriage 11, the control device 50 (the head position detecting unit 57) detects the position of the inkjet head 12 in the head moving direction. In S205, the control device 50 (the representative deviation calculating unit 58) calculates, serially as needed, a representative value for the intersection deviation value based on the interpolation function G(X) having the constant C determined in S202, the correction coefficient k determined in S202, and the position of the inkjet head 12 (corresponding to "X" of the interpolation function $G_N(X)$) detected in S204. Specifically, the control device 50 (the representative deviation calculating unit 58) determines, as the representative value for the intersection deviation value, a value resulting from substituting the value of "X" corresponding to the position of the inkjet head 12 into a representative interpolation function B(X). Here, the representative interpolation function B(X) is equivalent to the interpolation function G(X) multiplied by the correction coefficient k (i.e., B(X)=k·G(X)).

In S206, the control device 50 (the discharging timing determining unit 59) determines the ink discharging timing to discharge ink from the nozzles 10, based on the representative value for the intersection deviation value calculated in S205. Specifically, the following equation holds: $[H(X)-Z_0]:[F(X)-W_0]=U:V$, where "V" represents the speed of the carriage 11 in the head moving direction, and "U" represents the velocity of the discharged ink droplet in the vertical direction. Further, when an angle between the straight lines L1 and L2 in a deviation detecting pattern Q is represented by "θ," the following equation holds: $[F(X)-W_0]:[G(X)-Y_0]=\sin\theta:\cos\theta$. When the function of a delay time D of the adjusted ink discharging timing (moment) from the design-based ink discharging timing (moment) at a coordinate value X is represented by "E(X)," based on the difference in the ink discharging timing and the positional deviation value of the ink landing position, the following equation holds: $F(X)-W_0=V\cdot(E(X)-D_0)$. From the aforementioned equations, the function E(X) is expressed as follows.

$$E(X)=\frac{\tan\theta}{V}(B(X)-k\cdot Y_0)+D_0 \quad \text{(Expression 5)}$$

FIG. 8D is a graph showing the function D=E(X), which is transformable into a graph coincident with the graphs shown in FIGS. 8A to 8C by scaling and translation along the vertical axis.

In S207, the control device 50 (the recording control unit 51) controls the printing unit 2 to discharge ink from the nozzles 10 in accordance with the ink discharging timing determined in S206. The control device 50 repeatedly performs the steps S204 to S207 until determining that the printing operation is completed (S208: No). When determining that the printing operation is completed (S208: Yes), the control device 50 terminates the process shown in FIG. 10. It is noted that, in the embodiment, when the inkjet head 12 reaches a predetermined position, the control device 50 receives a signal from the encoder sensor 20 and controls the inkjet head 12 to discharge ink from the nozzles 10. Therefore, it is difficult for the inkjet head 12 to discharge ink from the nozzles 10 at a moment earlier than the design-based ink discharging timing (moment). Accordingly, a value satisfying the condition "D≥0" is always selected for "$D_0$."

In S206, the ink discharging timing is determined based on the representative value resulting from substituting the value of "X" into the representative interpolation function B(X). Alternatively, the ink discharging timing may be determined based on the intersection deviation value resulting from substituting the value of "X" into the interpolation function G(X).

However, the interpolation function G(X) is a function for interpolating the intersection deviation values based on the assumption that the nozzles to be used are formed in the specific portion. Therefore, with respect to nozzles 10 far away from the specific portion, the intersection deviation value calculated using the interpolation function G(X) is greatly different from the actual intersection deviation value. Hence, as described above, even though the central position (12*a*1, 12*a*2, or 12*a*3) in the head moving direction of the usage nozzle disposed area is set as the specific portion, when the ink discharging timing is determined based on the intersection deviation values calculated using the interpolation function G(X), it might cause large positional deviation values with respect to ink droplets discharged from nozzles 10 far away from the specific portion.

For example, as an extreme case, it is assumed that the width 2Δ of the usage nozzle disposed area is larger than the wavelength 2L of the wave shape. When the specific portion, which is located in the central position of the usage nozzle disposed area in the head moving direction, faces a top portion Pt of the wave shape, a nozzle 10, which is located the distance L away from the specific portion in the head moving direction, faces a bottom portion Pb of the wave shape. In this state, when ink droplets are discharged onto the top portion Pt with properly adjusted ink discharging timing (in this case, since the flying times of the discharged ink droplets are short because of a small gap between the ink discharging surface 12*a* and the top portion Pt, it is possible to render the actual landing positions of the discharged ink droplets close to the intended landing positions by adjusting the ink discharging timing with a delay time), an ink droplet discharged from a nozzle 10 located the distance L away from the specific portion lands in a position even farther away from the intended landing position (since the flying time of the ink droplet is relatively longer because of a relatively larger gap between the nozzle 10 and the recording sheet P). In such a case, by not adjusting the ink discharging timing, it is possible to avoid a rise of the maximum positional deviation value with respect to the ink landing position and achieve a small distance between the actual ink landing position and the intended ink landing position. Even though the size of the inkjet head 12 and the interval for the corrugated plates 15 are designed such that the width 2Δ of the usage nozzle disposed area is always larger than the wavelength 2L of the wave shape, in general, as the ratio p(=Δ/L) of the width 2Δ of the usage nozzle disposed area to the wavelength 2L of the wave shape is greater, the delay time for adjusting the ink discharging timing is desired to be so short as to avoid a rise of the maximum positional deviation value with respect to the ink landing position.

In the embodiment, the representative value for the intersection deviation value is calculated using the representative interpolation function B(X), which is equivalent to the interpolation function G(X) multiplied by a predetermined constant value (0≤k≤1) of the correction coefficient k. Then, the ink discharging timing is determined based on the calculated representative value. When 0≤p≤1, it is known that the correction coefficient k has such a specific value, definitely determined within the range 0≤k≤1, as to minimize the maximum positional deviation value with respect to the ink landing position. Thereby, with respect to a nozzle 10 close to the specific portion, the calculated representative value for the intersection deviation value is away from the actual intersection deviation value. Meanwhile, with respect to a nozzle 10 away from the specific portion, the calculated representative value for the intersection deviation value is close to the actual intersection deviation value. Accordingly, it is possible to reduce the maximum difference between the representative value for the intersection deviation value calculated using the representative interpolation function B(X) and the actual intersection deviation values (hereinafter referred to as the maximum difference with respect to the intersection deviation value).

Further, in the embodiment, as described above, the central position (12*a*1, 12*a*2, or 12*a*3) of the usage nozzle disposed area (the area R1, R2, or R3) in the head moving direction is set as the specific portion. Therefore, the gap between the nozzle rows (9*a* or 9*b*) to be used and the recording sheet P is not greatly different from the gap between the specific portion and the recording sheet P. Thus, it is possible to further reduce the maximum difference with respect to the intersection deviation value.

Further, in this case, when the representative value for the intersection deviation value calculated using the representative interpolation function B(X) is a center value (the average value of the maximum value and the minimum value) of the actual intersection deviation values caused by the used nozzle rows (9*a* or 9*b*), it is possible to minimize the maximum difference with respect to the intersection deviation value.

Here, the absolute value of the intersection deviation value Y relative to the average value $Y_0$ has maximum values on the top portion Pt and the bottom portion Pb of the recording sheet P. Further, in these cases ($X=X_N$ and $X_{N+1}$), the center values $Y'_N$ and $Y'_{N+1}$ of the intersection deviation values Y are expressed as follows.

$$Y'_N = \frac{G(X_N) + G(X_N + \Delta)}{2} = Y_N - \frac{Y_{N+1} - Y_N}{2L^3}\Delta^2(3L - 2\Delta) \quad \text{(Expressions 6)}$$

$$Y'_{N+1} = \frac{G(X_{N+1}) + G(X_{N+1} + \Delta)}{2} = Y_{N+1} - \frac{Y_{N+1} - Y_N}{2L^3}\Delta^2(3L - 2\Delta)$$

Further, the aforementioned function $Y=G_N(X)$ is a general expression of a curve formed to connect two points so as to have a slope equal to "0" at each end of a segment defined in the X axis. Hence, an expression resulting from replacing $Y_N$ and $Y_{N+1}$ with $Y'_N$ and $Y'_{N+1}$ in the expression $Y=G_N(X)$, respectively, is regarded as a relational expression of the center values $Y'_N$ and $Y'_{N+1}$. Thus, by replacing $Y_N$ and $Y_{N+1}$ with $Y'_N$ and $Y'_{N+1}$ in the expression $Y=G_N(X)$, respectively, under an assumption that $Y'_N$ is nearly equal to $Y'_{N+1}$ (the height of the top portion Pt relative to the average height $Z_0$ of the recording sheet P is nearly equal to the depth of the bottom portion Pb relative to the average height $Z_0$), the following relational expression is obtained.

$$B(X)=(1+2p^3-3p^2)C(X) \quad \text{(Expression 7)}$$

From the expression 7, it is understood that the correction coefficient $k=1+2p^3-3p^2$ provides an approximate expression effective to minimize the maximum difference with respect to the intersection deviation value. It is also understood that, when $p>1$, the optimum value of the correction coefficient k is "0" (k=0) as described above, and it is impossible to correct the positional deviation value with respect to the ink landing position by adjusting the ink discharging timing. Accordingly, it is possible to correct the positional deviation value with respect to the ink landing position only when the usage nozzle disposed area satisfying the condition "$p\leq 1$" is employed in the printing operation.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations about the same configurations as exemplified in the aforementioned embodiment will be omitted.

MODIFICATIONS

In the aforementioned embodiment, the position of the specific portion is changed by changing the value of the constant C depending on the printing mode. However, for instance, in the case where the same nozzles 10 are always used in the printing operation (including a case where all the nozzles 10 are always used in the printing operation), at the stage to determine the interpolation function G(X) in S104, the value of the constant C may be determined in such a manner that the specific portion is set in a central position in the head moving direction of the area of the ink discharging surface 12*a* where the nozzles 10 are disposed.

In the aforementioned embodiment, the interpolation function $G_N(X)$ is represented by the cubic function. However, in S102, by increasing the number of the portions for acquiring the intersection deviation values thereon to increase the number of conditional equations, the interpolation function $G_N(X)$ may be represented by a polynomial expressed as a biquadratic function or a higher-order function. Alternatively, in the position where the interpolation function $G_N(X)$ in the segment $S_N$ is connected with the interpolation function $G_{N+1}(X)$ in the adjacent segment $S_{N+1}$, the change rate of the functions with respect to the coordinate X may separately be determined, and the interpolation function G(X) may be determined as third-order pluralistic simultaneous equations with the determined change rate as a boundary condition. Further, when the interpolation function $G_N(X)$ is not required to smoothly connect with the interpolation functions $G_{N-1}(X)$ and $G_{N+1}(X)$ of the adjacent segments $S_{N-1}$ and $S_{N+1}$, the interpolation function $G_N(X)$ may be determined as a polynomial of the second or lower order. Or the interpolation function $G_N(X)$ may be determined as a function such as a sine function other than the polynomial.

Further, the intersection deviation value may not necessarily be determined as the interpolation function G(X). For instance, in S102, the intersection deviation value may be acquired with respect to every deviation detecting pattern Q. Further, the acquired intersection deviation value may be converted into an intersection deviation value based on an assumption that the nozzles 10 to be used are formed in the specific portion (i.e., the correspondence between "X" and the intersection deviation value may be changed under the assumption that the nozzles 10 to be used are formed in the specific portion). Moreover, a value resulting from multiplying the converted intersection deviation value by the correction coefficient k may be set as a representative value for the intersection deviation value.

In the aforementioned embodiment, based on an assumption that the interpolation function G(X) is a cubic function, the expression "$k=1+2p^3-3p^2$" is determined as an optimum expression for the correction coefficient k. As described above, the interpolation function G(X) may be represented by a function other than the cubic function, or the intersection deviation value may be acquired with respect to every deviation detecting pattern Q. However, the actual variation of the intersection deviation value with respect to the head moving direction is not so different from the variation approximated using the aforementioned cubic function. Therefore, even when an approximate value of the correction coefficient k determined using the expression "$k=1+2p^3-3p^2$" is practically used as an optimum value of the correction coefficient k, the practical use of the approximate value provides advantageous effects.

In the aforementioned embodiment, the correction coefficient k is expressed as "$k=1+2p^3-3p^2$." However, for instance, the correction coefficient k may be expressed as a function of the ratio $p(=\Delta/L)$ other than the above expression. When the wavelength 2L of the wave shape of the recording sheet P, that is, the period of the variation of the gap is short, the interval between the top portions Pt and the bottom portions Pb is short. Namely, a slight change in the position in the head moving direction causes a large change in the actual gap between the ink discharging surface 12*a* and the recording sheet P. Further, as the width 2Δ of the usage nozzle disposed area in the head moving direction is larger, the central position of the usage nozzle disposed area in the head moving direction is farther away from the end positions thereof, and thus, it results in a greater gap difference between the central position and the end positions. In other words, the wavelength 2L and the width 2Δ have great influences on the actual gap in an area away from the specific portion. Accordingly, when the correction coefficient k is expressed as a function of the ratio $p(=\Delta/L)$, it is possible to appropriately determine the correction coefficient k, which is determined based on the wavelength 2L and the width 2Δ.

Further, the correction coefficient k may be a value determined to satisfy the condition "$0\leq k\leq 1$" independently of the value of the ratio p. It is noted that the case where k=0 includes, for example, the aforementioned case where the width 2Δ of the usage nozzle disposed area in the head moving direction is equal to or more than the wavelength 2L of the wave shape.

Meanwhile, the case where k=1 includes, for example, a case where the printing operation is performed using the inkjet head 12 with a single nozzle row 9*a* in the first printing mode. In this case, since only the single nozzle row 9*a* is used in the printing operation, there is not caused any difference between different nozzle rows with respect to the gap between the ink discharging surface 12*a* and the recording sheet P.

In the aforementioned embodiment, the specific portion is set in an area located in the central position in the head moving direction within the usage nozzle disposed area of the ink discharging surface 12*a*. However, the specific portion may be set in a different area within the usage nozzle disposed area.

In the aforementioned embodiment, the intersection deviation values are acquired by reading the printed deviation detecting patterns Q using the image scanner 61 provided separately from the inkjet printer 1, e.g., at a stage of manufacturing the inkjet printer 1. However, for instance, the control device 50 (the reading control unit 52) may control the reading unit 5 to read the deviation detecting patterns Q to acquire the intersection deviation values.

Further, in the modification, the inkjet printer 1 needs to have the reading unit 5 to read the deviation detecting patterns Q. Meanwhile, in the aforementioned embodiment, the image scanner 61 provided separately from the inkjet printer 1 reads the deviation detecting patterns Q. Therefore, the inkjet printer 1 may be configured to perform only printing, without the reading unit 5.

In the aforementioned embodiment, the deviation detecting patterns Q each of which has the straight lines L1 and L2 intersecting each other are printed. However, the deviation detecting pattern may be another pattern configured to produce a printed result varying depending on the positional deviation value with respect to the ink landing position.

In the aforementioned embodiment, information on the variation of the intersection deviation value is acquired as information on the variation of the gap between the ink discharging surface 12*a* and the wave-shaped recording sheet P. However, different information may be acquired about the variation of a parameter, related to the gap, other than the intersection deviation value. Further, information about the variation of the gap may be acquired by direct measurement of the gap.

What is claimed is:

1. An inkjet printer comprising:

an inkjet head configured to discharge ink from a plurality of nozzles formed in an ink discharging surface thereof, the plurality of nozzles arranged in a plurality of nozzle rows along a first direction, the plurality of nozzle rows arranged along a second direction that intersects the first direction and is parallel to the ink discharging surface, the ink discharging surface including a specific portion located within an usage nozzle disposed area of the ink discharging surface where usage nozzle rows to be used in a printing operation, of the plurality of nozzle rows, are disposed;

a head moving unit configured to move the inkjet head relative to a recording sheet along the second direction;

a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions alternately arranged along the second direction; and a control device configured to:

acquire gap information related to a gap between the specific portion of the ink discharging surface and the recording sheet; and determine representative gap information using the acquired gap information, a width of the usage nozzle disposed area in the second direction, and a wavelength of the predetermined wave shape of the recording sheet, the representative gap information corresponding to a representative gap that represents respective gaps between the usage nozzle rows and the recording sheet deformed in the predetermined wave shape.

2. The inkjet printer according to claim 1, wherein the control device is further configured to:

calculate gap information based on the acquired gap information, the width of the usage nozzle disposed area in the second direction, and the wavelength of the predetermined wave shape of the recording sheet; and determine the representative gap information based on the acquired gap information and the calculated gap information.

3. The inkjet printer according to claim 2, wherein the representative gap information corresponds to an average value of a maximum value and a minimum value of the respective gaps between the usage nozzle rows within the usage nozzle disposed area and the recording sheet deformed in the predetermined wave shape.

4. The inkjet printer according to claim 3, wherein one of the acquired gap information and the calculated gap information includes the maximum value of the respective gaps and the other of the acquired gap information and the calculated gap information includes the minimum value of the respective gaps.

5. The inkjet printer according to claim 1, wherein the control device is further configured to determine a plurality of pieces of representative gap information depending on positions of the specific portion in the second direction, the positions corresponding to positions, in the second direction, of the top portions of portions protruding in the third direction and the bottom portions of portions protruding in the fourth direction of the predetermined wave shape.

6. The inkjet printer according to claim 1, wherein the control device is further configured to:

determine a variation of the representative gap information as a function of a position of the specific portion in the second direction; and determine ink discharging timing to discharge ink from the usage nozzle rows, based on the variation of the representative gap information, under an assumption that the respective gaps between the usage nozzle rows and the recording sheet deformed in the predetermined wave shape are equal to the representative gap.

7. The inkjet printer according to claim 1, wherein the specific portion is located in a central position of the usage nozzle disposed area in the second direction.

8. The inkjet printer according to claim 1,
wherein the plurality of nozzle rows comprise:
black nozzle rows configured to discharge black ink; and
color nozzle rows configured to discharge color ink,
wherein the control device is further configured to:
select one of at least three printing modes comprising:
a first printing mode to use only the black nozzle rows as the usage nozzle rows;
a second printing mode to use only the color nozzle rows as the usage nozzle rows; and
a third printing mode to use the black nozzle rows and the color nozzle rows as the usage nozzle rows; and
determine the representative gap information, using the width of the usage nozzle disposed area in the second direction, the usage nozzle disposed area being defined based on the usage nozzle rows to be used in the selected printing mode.

9. An inkjet printer comprising:
an inkjet head configured to discharge ink from a plurality of nozzles formed in an ink discharging surface thereof, the plurality of nozzles being arranged in a plurality of nozzle rows along a first direction, the plurality of nozzle rows being arranged along a second direction that intersects with the first direction and is parallel to the ink discharging surface, the ink discharging surface including a specific portion located within an usage nozzle disposed area of the ink discharging surface where usage nozzle rows to be used in a printing operation, of the plurality of nozzle rows, are disposed;
a head moving unit configured to move the inkjet head relative to a recording sheet, along the second direction;
a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions being alternately arranged along the second direction;
an acquiring device configured to acquire gap information related to a gap between the specific portion of the ink discharging surface and the recording sheet; and
a first determining device configured to determine representative gap information using the acquired gap information, a width of the usage nozzle disposed area in the second direction, and a wavelength of the predetermined wave shape of the recording sheet, the representative gap information corresponding to a representative gap that represents respective gaps between the usage nozzle disposed area and the recording sheet deformed in the predetermined wave shape.

10. The inkjet printer according to claim 9,
wherein the first determining device is further configured to:
calculate gap information based on the acquired gap information, the width of the usage nozzle disposed area in the second direction, and the wavelength of the predetermined wave shape of the recording sheet; and
determine the representative gap information based on the acquired gap information and the calculated gap information.

11. The inkjet printer according to claim 10,
wherein the representative gap information corresponds to an average value of a maximum value and a minimum value of the respective gaps between the usage nozzle rows within the usage nozzle disposed area and the recording sheet deformed in the predetermined wave shape.

12. The inkjet printer according to claim 11,
wherein one of the acquired gap information and the calculated gap information includes the maximum value of the respective gaps and the other of the acquired gap information and the calculated gap information includes the minimum value of the respective gaps.

13. The inkjet printer according to claim 9,
wherein the acquiring device is further configured to acquire a plurality of pieces of representative gap information depending on positions of the specific portion in the second direction, the positions corresponding to positions, in the second direction, of the top portions of portions protruding in the third direction and the bottom portions of portions protruding in the fourth direction of the predetermined wave shape.

14. The inkjet printer according to claim 9, further comprising:
a second determining device configured to determine a variation of the representative gap information as a function of a position of the specific portion in the second direction; and
a third determining device configured to determine ink discharging timing to discharge ink from the usage nozzle rows, based on the variation of the representative gap information, under an assumption that the respective gaps between the usage nozzle rows and the recording sheet deformed in the predetermined wave shape are equal to the representative gap.

15. The inkjet printer according to claim 9,
wherein the specific portion is located in a central position of the usage nozzle disposed area in the second direction.

16. The inkjet printer according to claim 9,
wherein the plurality of nozzle rows comprise:
black nozzle rows configured to discharge black ink; and
color nozzle rows configured to discharge color ink,
wherein the inkjet printer further comprises a printing mode selecting device configured to select one of at least three printing modes comprising:
a first printing mode to use only the black nozzle rows as the usage nozzle rows;
a second printing mode to use only the color nozzle rows as the usage nozzle rows; and
a third printing mode to use the black nozzle rows and the color nozzle rows as the usage nozzle rows, and
wherein the usage nozzle disposed area used by the first determining device is defined based on the usage nozzle rows to be used in the selected printing mode.

17. An inkjet printer comprising:
an inkjet head configured to discharge ink from a plurality of nozzles formed in an ink discharging surface thereof, the plurality of nozzles arranged in a plurality of nozzle rows along a first direction, the plurality of nozzle rows arranged along a second direction that intersects with the first direction and is parallel to the ink discharging surface;
a head moving unit configured to move the inkjet head relative to a recording sheet along the second direction;
a wave shape generating mechanism configured to deform the recording sheet in a predetermined wave shape that has top portions of portions protruding in a third direction toward the ink discharging surface and bottom portions of portions recessed in a fourth direction opposite to the third direction, the top portions and the bottom portions alternately arranged along the second direction;

a gap variation acquiring device configured to acquire gap variation information related to a variation of a gap between a specific portion of the ink discharging surface and the recording sheet deformed in the predetermined wave shape as a function of a position of the inkjet head in the second direction, the specific portion being located within an usage nozzle disposed area of the ink discharging surface where usage nozzle rows to be used in a printing operation, of the plurality of nozzle rows, are disposed; and a determining device configured to determine representative gap variation information related to a variation, as a function of the position of the inkjet head in the second direction, of a representative gap that represents respective gaps between the usage nozzle rows and the recording sheet deformed in the predetermined wave shape, using a width of the usage nozzle disposed area in the second direction and a wavelength of the predetermined wave shape of the recording sheet.

18. The inkjet printer according to claim 17, wherein the determining device is further configured to:

calculate gap variation information based on the acquired gap variation information, the width of the usage nozzle disposed area in the second direction, and the wavelength of the predetermined wave shape of the recording sheet; and determine the representative gap variation information based on the acquired gap variation information and the calculated gap variation information.

19. The inkjet printer according to claim 17, wherein the specific portion is located in a central position of the usage nozzle disposed area in the second direction.

20. The inkjet printer according to claim 17, wherein the determining device is configured to:

determine, from the representative gap variation information, a plurality of pieces of first representative gap information respectively corresponding to the top portions of portions protruding in the third direction of the recording sheet deformed in the predetermined wave shape, each piece of first representative gap information corresponding to a representative gap that represents respective gaps between the usage nozzle rows within the usage nozzle disposed area and a corresponding top portion of portions protruding in the third direction of the recording sheet deformed in the predetermined wave shape;

determine, from the representative gap variation information, a plurality of pieces of second representative gap information respectively corresponding to the bottom portions of portions protruding in the fourth direction of the recording sheet deformed in the predetermined wave shape, each piece of second representative gap information corresponding to a representative gap that represents respective gaps between the usage nozzle rows within the usage nozzle disposed area and a corresponding bottom portion of portions protruding in the fourth direction of the recording sheet deformed in the predetermined wave shape;

replace each piece of first representative gap information with a first average value of a maximum value and a minimum value among the respective gaps between the usage nozzle rows within the usage nozzle disposed area and the corresponding top portion of portions protruding in the third direction of the recording sheet deformed in the predetermined wave shape, using the width of the usage nozzle disposed area in the second direction and the wavelength of the predetermined wave shape of the recording sheet; and replace each piece of second representative gap information with a second average value of a maximum value and a minimum value among the respective gaps between the usage nozzle rows within the usage nozzle disposed area and the corresponding bottom portion of portions protruding in the fourth direction of the recording sheet deformed in the predetermined wave shape, using the width of the usage nozzle disposed area in the second direction and the wavelength of the predetermined wave shape of the recording sheet.

* * * * *